US005775897A

United States Patent [19]

Smith

[11] Patent Number: 5,775,897

[45] Date of Patent: Jul. 7, 1998

[54] GASEOUS FLOW REVERSING VALVE WITH DISTRIBUTED GAS FLOW

[75] Inventor: Daniel P. Smith, Worcester, Mass.

[73] Assignee: Morgan Construction Company, Worcester, Mass.

[21] Appl. No.: 814,971

[22] Filed: Mar. 11, 1997

[51] Int. Cl.[6] ..... F27D 17/00

[52] U.S. Cl. ..... 432/181; 432/180; 137/309

[58] Field of Search ..... 432/179, 180, 432/181; 137/309

[56] References Cited

U.S. PATENT DOCUMENTS

| | | | |
|---|---|---|---|
| 3,184,223 | 5/1965 | Webber | 137/309 |
| 3,870,474 | 3/1975 | Houston . | |
| 4,088,180 | 5/1978 | Tsai . | |
| 4,398,590 | 8/1983 | Leroy | 432/180 |
| 4,522,588 | 6/1985 | Todd et al. | 432/181 |
| 4,604,051 | 8/1986 | Davies et al. . | |
| 4,744,409 | 5/1988 | Berner . | |
| 5,092,767 | 3/1992 | Dehlsen . | |
| 5,134,945 | 8/1992 | Reimlinger et al. . | |
| 5,401,465 | 3/1995 | Smith . | |

*Primary Examiner*—Henry A. Bennett
*Assistant Examiner*—Gregory A. Wilson
*Attorney, Agent, or Firm*—Samuels, Gauthier, Stevens & Reppert

[57] ABSTRACT

A gaseous flow reversing system is disclosed for use with a regenerative furnace. The reversing system includes a combustion air inlet unit for receiving combustion air, and a valve unit. The valve unit is slidable between first and second positions with respect to the combustion air inlet unit for alternately directing the flow of combustion air from between the combustion air inlet unit and a first regenerator port when the valve unit is in the first position, and from between the combustion air inlet unit and a second regenerator port when the valve unit is in the second position. The valve unit includes valve flow distribution channels for distributing the flow of the combustion air into at least one of the regenerator ports from among a plurality of locations extending along the valve unit.

17 Claims, 2 Drawing Sheets

GASEOUS FLOW REVERSING VALVE WITH DISTRIBUTED GAS FLOW

BACKGROUND OF THE INVENTION

The invention relates to systems for recovering waste heat generated during combustion in a regenerative furnace, and in particular relates to an improvement in the valving employed to alternate and reverse the flow of high temperature exhaust gases and combustion air through parallel sets of regenerators employed with such furnaces.

In a conventional regenerative furnace installation, two sets of regenerators are arranged in parallel between the furnace combustion chamber and a common exhaust stack. The regenerators contain open brickwork, and are commonly referred to as "checkers." A reversing valve of the type disclosed, for example, in U.S. Pat. No. 3,184,223 is employed to direct incoming combustion air through one set of checkers while allowing high temperature exhaust gases to pass through the other set of checkers to the exhaust stack. The reversing valve is periodically shifted to alternate the flow of combustion air and exhaust gases through the parallel checkers. Thus, the brickwork in a given set of checkers will be heated by the outgoing high temperature exhaust gases to thereby recover and store waste heat, and the recovered waste heat will subsequently be employed to preheat incoming combustion air when the reversing valve is shifted. The disclosure of U.S. Pat. No. 3,184,223 is herein incorporated by reference.

Experience has shown that the incoming combustion air tends to flow unevenly through the reversing valve, which in turn produces an uneven flow through the checkers. This leads to a loss of efficiency, i.e., some of the checker brickwork cools quickly while other portions of the brickwork remain hot and do not impact their recovered energy to the incoming flow of combustion air.

The object of the present invention is to provide a more even distribution of combustion air flow to and through the reversing valve to the checkers, thereby increasing the efficiency of heat recovery in the checkers.

SUMMARY OF THE INVENTION

The present invention modifies the conventional reversing valve disclosed in U.S. Pat. No. 3,184,223 by subdividing both the combustion air supply conduit and the internal chamber of the reversing valve into a plurality of separate channels configured and arranged to more evenly distribute the flow of combustion air therethrough. The channels of the combustion air supply conduit have outlets communicating with the valve chamber and separated one from the other in a direction transverse to the path of valve movement between its two positions of adjustment. The channels of the valve chamber extend in directions parallel to the path of valve movement, and each valve channel communicates with all of the channels of the combustion air supply conduit.

BRIEF DESCRIPTION OF THE DRAWINGS

The following description of the invention will be further understood with reference to the accompanying drawings in which.

DETAILED DESCRIPTION OF THE ILLUSTRATED EMBODIMENTS

Figure 1:
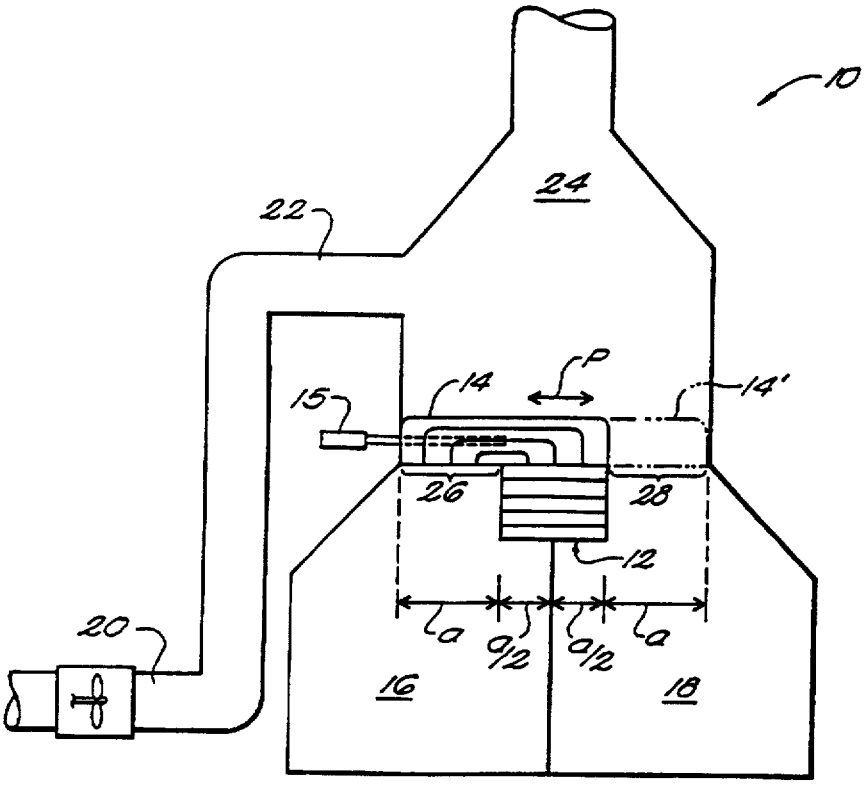
FIG. 1 is a schematic view of a regenerative furnace heat recovery system of the type described in U.S. Pat. No. 3,184,223, with a modified valve arrangement in accordance with the present invention.

With reference initially to FIG. 1, a regenerative furnace heat recovery system is generally indicated at 10. The system includes a combustion air supply conduit 12, a reversing valve 14, and a pair of checkers 16 and 18. In alternative embodiments, the areas 16 and 18 may be ducts or hooded chambers leading to checkers. The system may also include a blower 20 for directing ambient air via duct 22 to an ejector (not shown) which assists in driving exhaust gasses out through an exhaust stack 24.

During a typical operating cycle, combustion air is supplied via the supply conduit 12. The conduit 12 is shown in rectangular form for diagrammatic purposes. In various embodiments, the conduit 12 may be of a variety of cross-sectional shapes, e.g., trapezoidal, to permit the conduit 12 to be adapted to a variety of existing furnace systems. The combustion air passes up into the valve 14 and then down through a port 26 over which the valve 14 is positioned and into the checker 16. As the combustion air passes through the checker 16 and possibly through a second communicating checker (not shown), it picks up heat from the checker brickwork before reaching the combustion chamber of the furnace (not shown). The exhaust gases from the furnace combustion chamber exit through the other parallel checker 18 and are drawn up through the port 28 and out the exhaust stack 24.

When the valve is shifted along path "P" to its alternate position indicated by the broken lines at 14 in FIG. 1, it is positioned above the other port 28 leading to checker 18, permitting the exhaust gasses to exit through the regenerator 16 and port 26, while directing incoming combustion air via port 28 to checker 18. The movement of the reversing valve 14 may be controlled by any conventional means, such as for example a linear actuator 15. As shown in FIG. 1, the distance a across each of the ports 26 and 28 is equal to the width of the conduit 12, ensuring that the valve 14 completely covers both the conduit 12 and alternately either of the ports 26 or 28.

Figure 2:
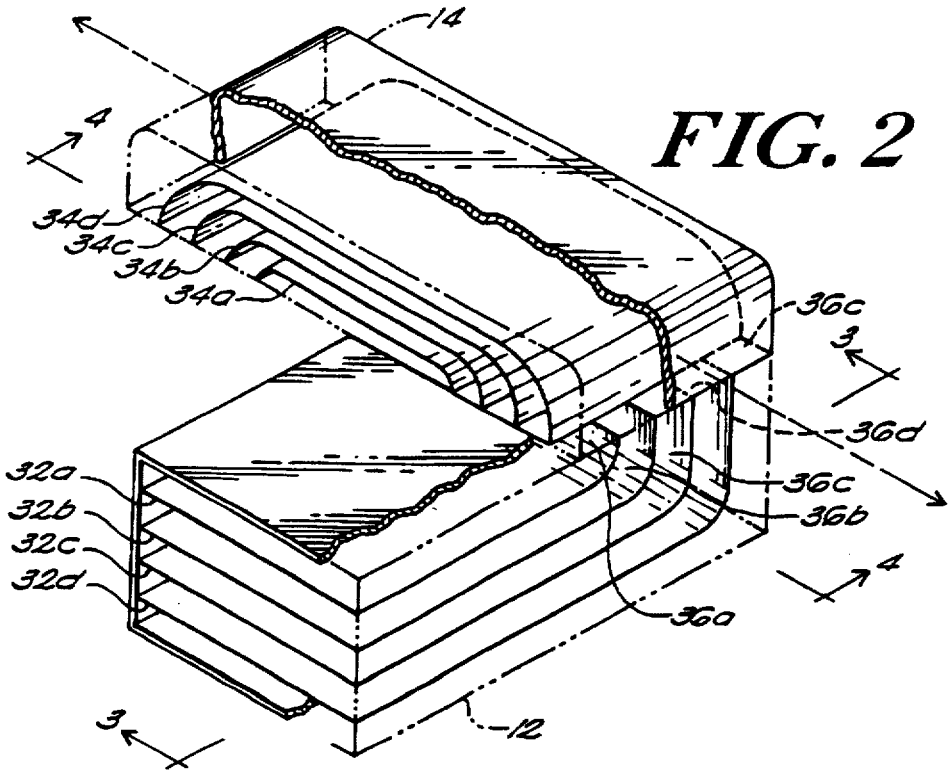
FIG. 2 is a diagrammatic perspective view illustrating the relationship between the reversing valve and combustion air inlet conduit of the system shown in FIG. 1.
Figure 3:
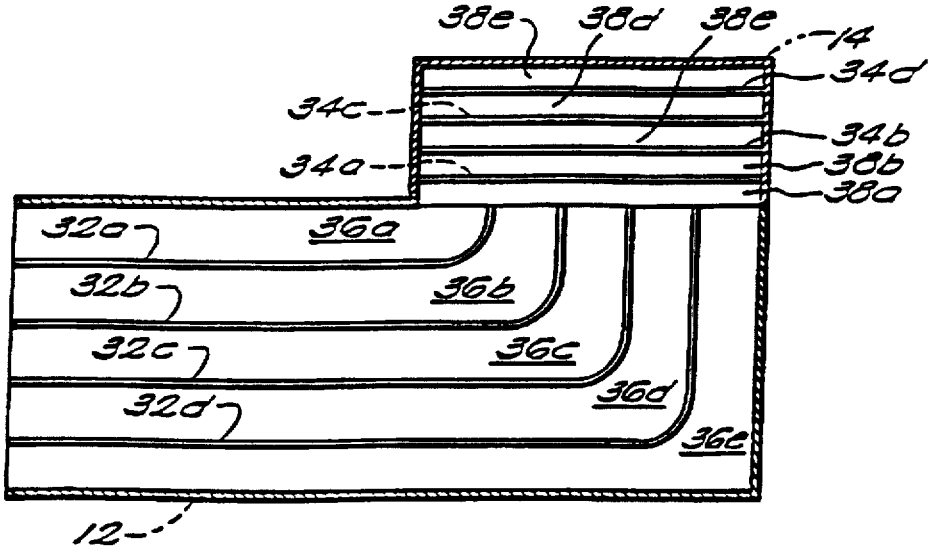
FIG. 3 is an elevational view of the system shown in FIG. 2 taken along line 3—3 thereof.
Figure 4:
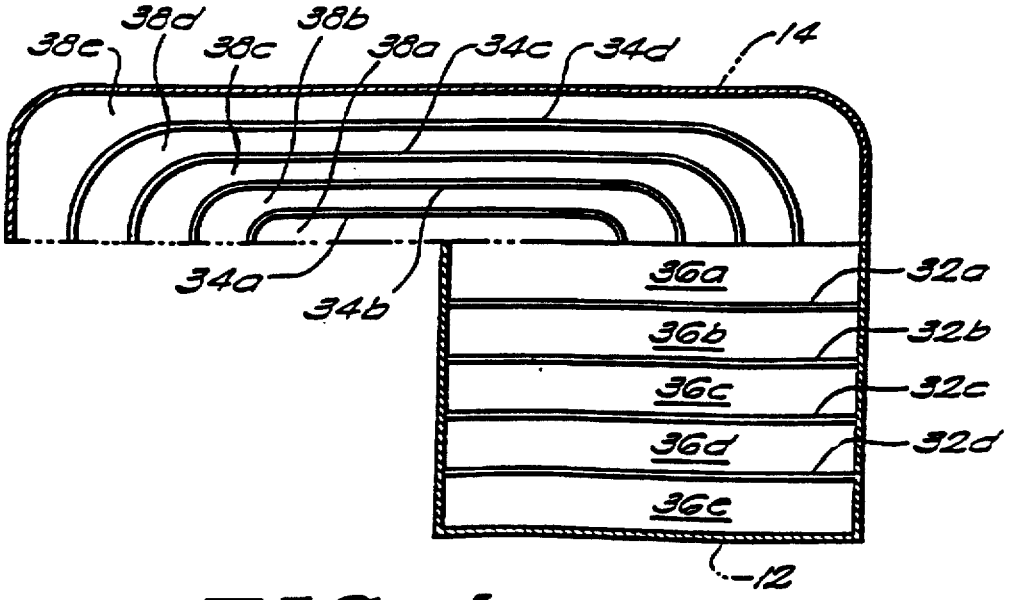
FIG. 4 is a elevational view of the system shown in FIG. 2 taken along line 4—4 thereof.

As shown in FIG. 2, the supply conduit 12 and valve 14 are provided respectively with internal partitions 32*a–d* and 34*a–d*. The partitions 32 each extend across the inlet conduit 12, are generally L-shaped, and subdivide the supply conduit into a plurality of channels 36*a–e* having outlets spaced one from the other in a direction transverse to the path "P" of valve movement.

The partitions 34 each extend across the valve 14, and are generally U-shaped, and are configured to internally subdivide the valve into a plurality of channels 38*a–e* extending in directions parallel to the path "P." With this arrangement, each channel 36 of the supply conduit 12 communicates with each channel 38 of the valve, and vice versa.

The combustion air is therefore first distributed across the width of the valve 14 in the channels 36*a*–36*e* between the partitions 32*a*–32*d* of the supply conduit 12. Each of these flows of combustion air is then further divided by the valve partitions 34*a*–34*d* and distributed through channels 38*a–e* for delivery to either of the ports (26 or 28) over which the valve is seated. The combustion air entering each checker is therefore evenly distributed across the area of its port.

Those skilled in the art will appreciate that variations and modifications may be made to the above disclosed embodiment without departing from the spirit and scope of the invention.

What is claimed is:

1. For use with a regenerative furnace heat recovery system including a pair of regenerators connected respectively via first and second ports to a common exhaust stack, a delivery system for alternately supplying combustion air to one or the other of said ports, said system comprising:

a combustion air supply conduit arranged between said ports;

a valve member movable along a path in opposite directions between first and second positions, said valve member having a chamber configured to connect said combustion air supply conduit to said first port when in said first position, and to connect said combustion air supply conduit to said second port when in said second position;

means for subdividing said combustion air supply conduit into a plurality of supply channels having outlets communicating with said valve chamber and separated one from the other in a direction transverse to said path; and means for subdividing said valve chamber into a plurality of connecting channels separated one from the other and extending in the direction of said path, each of said connecting channels being in communication with each of said supply channels and vice versa when said valve is at said first and second positions.

2. A delivery system as claimed in claim 1, wherein said combustion air supply conduit further includes a plurality of partitions that subdivide said combustion air supply conduit into said plurality of supply channels.

3. A delivery system as claimed in claim 2, wherein said partitions are generally L-shaped and extend across said combustion air supply conduit in the direction of said path.

4. A delivery system as claimed in claim 3, wherein said partitions are positioned adjacent one another in spaced apart relation.

5. A delivery system as claimed in claim 1, wherein said valve chamber further includes a plurality of partitions that subdivide said valve chamber into said plurality of connecting channels.

6. A delivery system as claimed in claim 5, wherein said partitions are generally U-shaped and extend across said valve member in directions transverse to the direction of said path.

7. A delivery system as claimed in claim 6, wherein said partitions are positioned inside one another in spaced apart relation.

8. A gaseous flow reversing system for use with a regenerative furnace, said reversing system comprising:

a combustion air inlet unit for receiving combustion air, and a valve unit slidable along a path between first and second positions with respect to said combustion air inlet unit for alternately directing the flow of combustion air from said combustion air inlet unit to a first regenerator port when said valve unit is in said first position, and from said combustion air inlet unit to a second regenerator port when said valve unit is in said second position;

said combustion air inlet unit including inlet flow distribution means for distributing the flow of said combustion air into said valve unit among a plurality of locations extending along a direction that is transverse to said path; and said valve unit including valve flow distribution means for distributing the flow of said combustion air into one or the other of said regenerator ports from among a plurality of locations extending along said direction proximate said at least one regenerator port.

9. A system as claimed in claim 8, wherein said valve flow distribution means further provides for the distribution of the flow of said combustion air into each of said regenerator ports from among a plurality of locations extending along said path direction proximate each said regenerator port.

10. A system as claimed in claim 8, wherein said valve flow distribution means further provides for the distribution of the flow of said combustion air from said inlet unit to a plurality of locations extending along said path direction proximate said inlet unit.

11. A system as claimed in claim 8, wherein said inlet flow distribution means includes a plurality of partitions, each of which extends within said inlet unit along said path direction proximate said valve unit.

12. A system as claimed in claim 11, wherein each of said partitions is generally L-shaped, and said partitions are positioned adjacent one another in spaced apart relation.

13. A system as claimed in claim 8, wherein said valve flow distribution means further includes a plurality of partitions, each of which extends along said transverse direction proximate said inlet unit.

14. A system as claimed in claim 13, wherein each of said partitions is generally upside-down U-shaped, and said partitions are positioned inside one another in spaced apart relation.

15. A system as claimed in claim 8, wherein said valve unit is positioned above said inlet unit, and said first and second regenerator ports are positioned on either side of said inlet unit with said valve unit extending in said path direction above said inlet unit and said first regenerator port when said valve unit is in said first position, and extending in said path direction above said inlet unit and said second regenerator port when said valve unit is in said second position.

16. A system as claimed in claim 8, wherein said inlet unit further includes an inlet port for communication with a combustion air inlet conduit along said transverse direction.

17. A gaseous flow reversing system for use with a regenerative furnace, said reversing system comprising:

a combustion air inlet unit for receiving combustion air;

a valve unit slidable between first and second positions with respect to said combustion air inlet unit for alternately directing the flow of combustion air from said combustion air inlet unit to a first regenerator port when said valve unit is in said first position, and from said combustion air inlet unit to a second regenerator port when said valve unit is in said second position;

said valve unit including valve flow distribution channels for distributing the flow of said combustion air into at least one of said regenerator ports from among a plurality of locations extending along said valve unit.

* * * * *